United States Patent [19]

Chambers

[11] Patent Number: 4,468,194

[45] Date of Patent: Aug. 28, 1984

[54] AUTOMATIC FLAME SNUFFER FOR STORAGE TANK VENT LINES WITH MANUAL OVERRIDE

[75] Inventor: Roland A. Chambers, Rawlins, Wyo.

[73] Assignee: Marathon Oil Company, Findlay, Ohio

[21] Appl. No.: 478,561

[22] Filed: Mar. 24, 1983

[51] Int. Cl.[3] ..... F23Q 25/00

[52] U.S. Cl. ..... 431/152; 220/89 B; 137/77

[58] Field of Search ..... 431/144, 146, 152; 220/89 B; 137/75, 77

[56] References Cited

U.S. PATENT DOCUMENTS

| | | | |
|---|---|---|---|
| 471,615 | 3/1892 | King . | |
| 787,620 | 4/1905 | Gibbons | 431/146 |
| 1,059,191 | 4/1913 | Miller | 220/89 B |
| 1,162,019 | 11/1915 | Bowles . | |
| 1,238,983 | 12/1915 | Bowles . | |
| 1,265,877 | 5/1918 | Bowles . | |
| 1,298,872 | 4/1919 | Bowles . | |
| 1,573,938 | 2/1926 | Henrietta . | |
| 1,672,042 | 6/1928 | Schmidt et al. . | |
| 1,803,460 | 5/1931 | Brooks . | |
| 1,918,728 | 7/1933 | Wheaton . | |
| 2,913,320 | 11/1959 | Williams | 48/192 |
| 3,026,931 | 3/1962 | Krautkrämer | 431/146 |
| 3,613,942 | 10/1971 | Williams | 220/88 |

*Primary Examiner*—Harold W. Weakley

*Attorney, Agent, or Firm*—Jack L. Hummel; Rodney F. Brown

[57] ABSTRACT

An improved flame snuffer 30 for utilization on the vent line 20 of oil field atmospheric condensate storage tanks 10 is disclosed utilizing a valve 200, a fusible link 70, and a counterweight 80 connected to the valve 200 so that when the fusible link 70 melts in the presence of fire the counterweight 80 is released to close the valve over the vent 20. A container 40 holds the valve 200 and directs the outlet 22 of the vent line 20 into a downward path 100. A rod 50 connected to one end of the valve 200 has the counterweight 80 connected to its opposing end and the fusible link 70 is connected to the rod 50 and to a rigid arm 80 so that in the presence of a fire, the fusible link 70 melts releasing the rod 50 from the arm 80. A manual override 110, 120 is further provided to separate the rod 50 from arm 80 when a predetermined force is exceeded.

5 Claims, 4 Drawing Figures

AUTOMATIC FLAME SNUFFER FOR STORAGE TANK VENT LINES WITH MANUAL OVERRIDE

TECHNICAL FIELD

The present invention relates to an apparatus for automatically closing a vent upon the occurrence of a fire in the vent and, more particularly, to an automatic flame snuffer for oil field atmospheric condensate storage tank vent lines with manual override.

BACKGROUND OF ART

Occasionally lightening strikes the vent lines on oil field atmospheric condensate storage tanks and, because flammable vapors are being vented from the tanks, ignition may occur and the ensuing flame and fire can result in the loss of considerable product and equipment. Typically, such atmospheric condensate storage tanks are located in isolated areas and are not supervised by operating personnel. It is important, therefore, to provide automatic closure of the vent so that the flame will be quickly snuffed.

As a result of a patentability search conducted for the present invention, the following prior art approaches were uncovered:

| INVENTOR | U.S. PAT. NO. | DATE ISSUED |
|---|---|---|
| C. A. King | 471,615 | Mar. 29, 1892 |
| W. M. Bowles | 1,162,019 | Nov. 30, 1915 |
| W. M. Bowles | 1,238,983 | Sept. 4, 1917 |
| W. M. Bowles | 1,265,877 | May 14, 1918 |
| W. M. Bowles | 1,298,872 | Apr. 1, 1919 |
| V. M. Henrietta | 1,573,938 | Feb. 23, 1926 |
| G. C. Schmidt | 1,672,042 | June 5, 1928 |
| S. H. Brooks | 1,803,460 | May 5, 1931 |
| A. W. Wheaton | 1,918,728 | July 18, 1933 |
| J. R. Williams | 2,913,320 | Nov. 17, 1959 |
| Clarence Williams | 3,613,942 | Oct. 19, 1971 |

The 1892 patent to King teaches the use of a fusible link which in the presence of fire will melt causing two valves to close thereby sealing off a glass liquid fuel level indicator. The melting of the fusible link causes a counterweight to act on a connecting rod to close the upper and lower valves. Thus, in the event of a fire in or near the tank, any rupturing of the glass liquid level gauge, which would spill fuel from the storage tank, is quickly closed under the teachings of the King invention.

The four patents to Bowles are all directed to safety vents for oil storage tanks and are generally constructed using weighted valves and fusible links to automatically close a valve located in the vent in case of fire. In U.S. Pat. No. 1,162,019, Bowles utilizes a fuse wire located in the vent for holding open a weighted valve. In the event of a fire in the vent, the fuse wire melts releasing the weighted valve to close over the vent. In U.S. Pat. Nos. 1,238,983 and 1,265,877, the aforesaid structure is modified by placing the fuse wire just beyond the outlet of the vent and by providing an alarm device. In U.S. Pat. No. 1,298,872, rather than using a fusible wire, Bowles utilizes a fusible link. The Bowles '872 patent also provides a hood over the vent to concentrate heat from the flame on the fusible element to more quickly close the valve.

In the 1933 patent to Wheaton (U.S. Pat. No. 1,918,728), a fusible link is utilized on the exterior of the tank and vent. Upon release due to a fire, a counterweighted lever releases an internal valve to close over the vent. A separate manual valve on the vent pipe is disclosed for also manually closing off the vent.

The 1925 patent issued to Henrietta et al (U.S. Pat. No. 1,573,938) utilizes a plurality of fusible elements located external of the tank and vent to close a valve located near the end of the vent.

The 1928 patent issued to Schmidt et al (U.S. Pat. No. 1,672,042) teaches the use of a manually actuated flame snuffer for a tank vent. A spring holds open a valve in normal operation and, in the event of fire, a chain is pulled closing the valve and snuffing the flame. When the fire is snuffed out, the chain is released and the spring biases the valve back into its normally open position.

The remaining patents uncovered in the search are believed not to be as pertinent to the present invention as those set forth and discussed above.

Of all of the above patents, only the four Bowles patents, the Henrietta et al and Schmidt et al patents are believed to be pertinent to the teachings of the present invention. The Bowles patents teach the use of a fused element directly in the outlet path of the vent. The Henrietta et al patent teaches the use of the safety valve being located near the end of the vent and the Schmidt et al patent teaches the use of a manual snuffer in case of a fire. However, none of these approaches suggest either individually or in combination with each other an approach involving a combined automatic and manual fire snuffer for closing the end of a tank vent line.

DISCLOSURE OF INVENTION

The problem faced in designing an automatic fire snuffer for oil field atmospheric condensate storage tank vent lines is to provide a valve that can be closed directly at the end of the vent line, to position the fusible link directly in the output path of the vent in order to rapidly sense flame and to have a manual override for closing the valve upon pulling a cable located at ground level remote from the valve.

In order to solve the above problem, the present invention contemplates the use of an improved flame snuffer utilizing a shutoff valve, a fusible link, and a counterweight connected to the valve and operatively connected to the fusible link so that in the presence of fire, the link melts to allow the counterweight to close the valve over the vent.

Under the teachings of the present invention, the valve container engages the end of the vent line in order to direct the outlet of the vent line into a downward path, a rod coupled at one end to the valve carries a counterweight at the opposing end, a rigid arm attached at one end to the valve container supports the fusible link and the rod in the downward path of the vent so that when a fire occurs the link melts causing the rod to release from the arm in order to close the valve.

Furthermore, a manual override is provided which is coupled to the counterweight so that when a cable is pulled a manual force is applied to the fusible link and, when a predetermined force is exceeded, the link releases from the arm in order to close the valve.

DISCLOSURE OF THE PREFERRED EMBODIMENT

Figure 1:
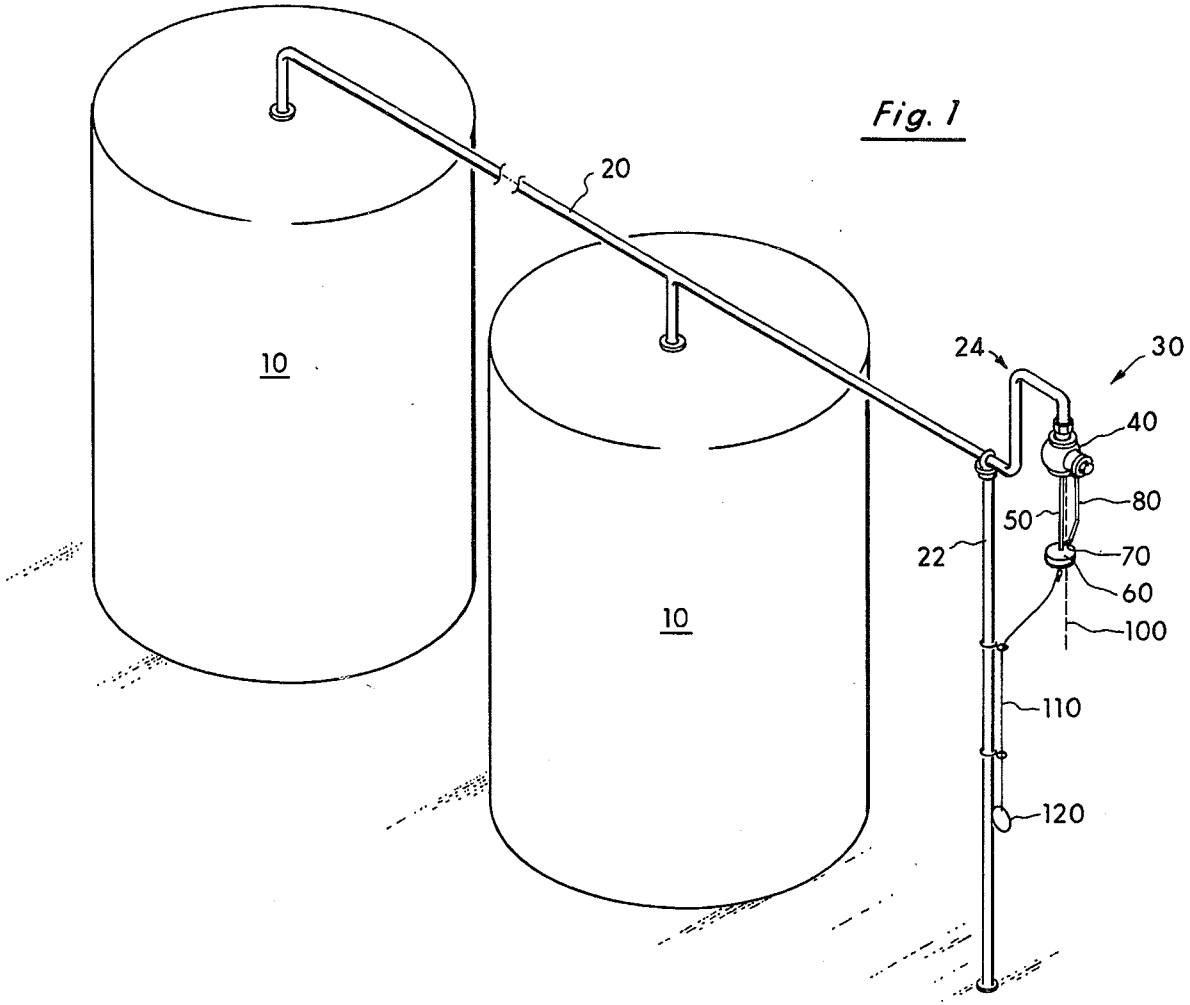
FIG. 1 sets forth an illustration, in perspective, showing an application of the present invention to atmospheric condensate storage tanks.

In FIG. 1 are shown a plurality of condensate storage tanks 10 interconnected to a tank vent line 20. The condensate storage tanks are typically geographically isolated and contain hydrocarbon product. The tank vent line 20 is necessary to bleed off flammable petroleum vapors from the tanks 10 to prevent pressure buildup. The storage tanks 10 and the tank vent line 20 present a possible hazzard when struck by lightening. Under lightening strikes, the flammable vapors can ignite causing destruction of the stored product and of the associated equipment.

Under the teachings of the present invention, an improved flame snuffer 30 is provided to rapidly extinguish any such fire. The flame snuffer 30 is positioned, in FIG. 1, by a configured pipe 24 to orient the vent in a downward direction and the end of the vent carrying the flame snuffer 30 is held up by means of support pole 20.

The improved flame snuffer 30 of the present invention includes a container 40 for holding a clapper or valve 200, a rod 50 connected to a counterweight 60 which are both supported through a fusible link 70 to a rigid arm 80 for holding the fusible link 70 in the path 100 of the flame, in the case of ignition, from the vent line 30. As shown in FIG. 1, the fusible link 70 is positioned by the rigid arm 80 in the downward output or outlet path 100 of the vent. In addition, a cable 110 is connected to the counterweight 60 and a lanyard 120 is connected to the cable 110 so that a manual override is provided to the valve 200 in container 40 in order to close off the tank vent line 20. In other words, the tank vent line 20 can be effectively sealed off either through action of melting the fusible link 70 or by pulling the lanyard 120 thereby shutting off the fuel supply for the fire.

Figure 2:
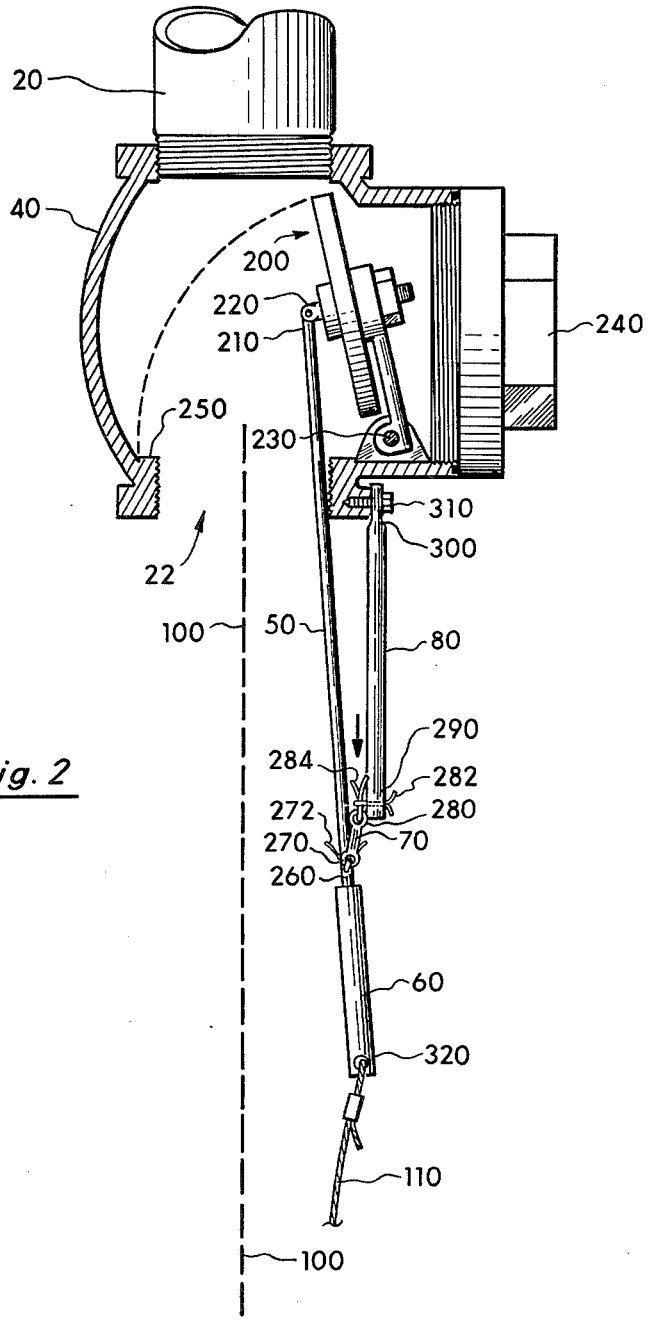
FIG. 2 is a cross-sectional view showing the flame snuffer of the present invention in the opened position.
Figure 3:
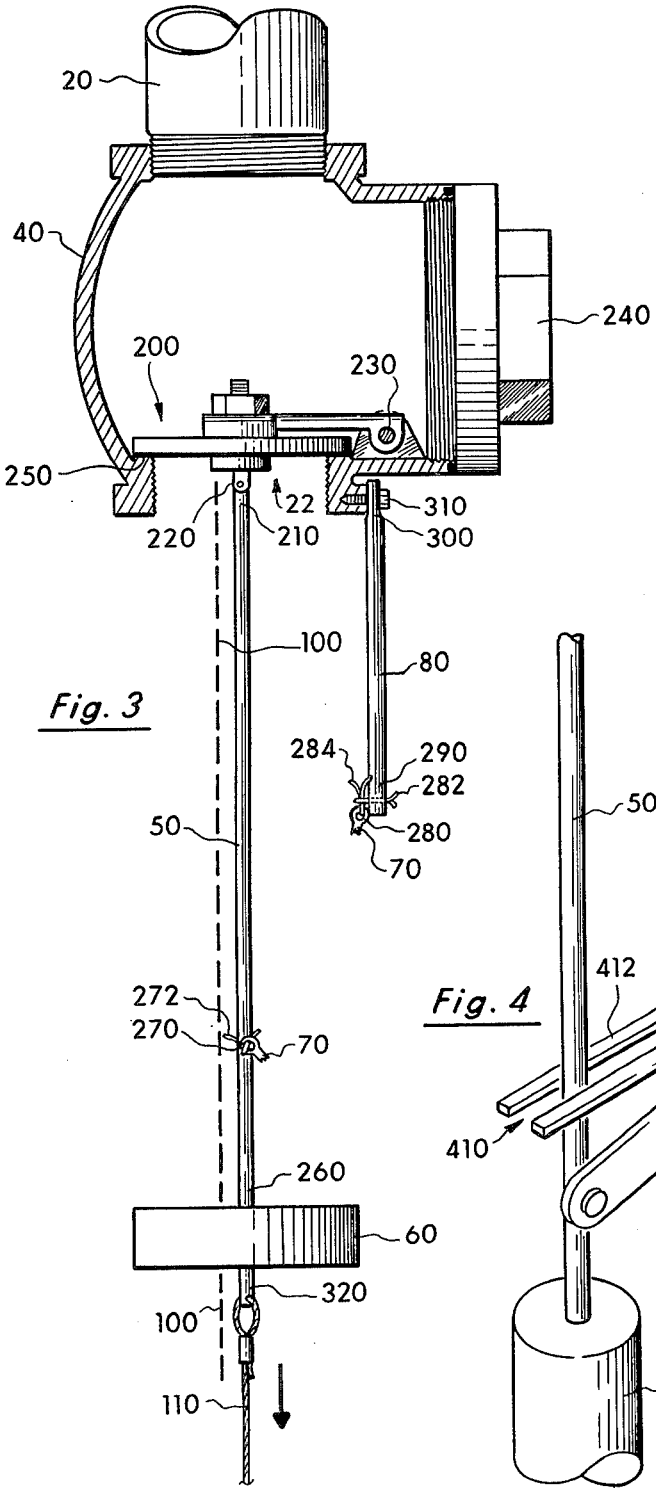
FIG. 3 is a cross-sectional view of FIG. 2 showing the flame snuffer of the present invention in the closed position.

In FIGS. 2 and 3, the improved flame snuffer 30 of the present invention is detailed and includes a conventional bronze valve container 40 holding a valve 200. The valve container 40 conventionally engages the tank vent line 20 by means of a screw coupling to provide a gas-tight seal.

A connecting rod 50 comprised of an elongated linear shaft is coupled at one end 210 to a pivotal coupler 220 which is affixed to the center bottom of the clapper on valve 200. Valve 200 is pivotally connected at point 230 to the valve container 40. The valve container 40 contains a plug 240 which can be unscrewed from the container 40 to service the valve 200. In the open position, as shown in FIG. 2, the valve 200 directs the output or outlet of the tank vent line 200 in a downward direction as indicated by dotted line 100. It is to be expressly understood that the container 40 or piping 24 can be configured to direct the outlet of the vent line in the downward path 100. In the closed position, as shown in FIG. 3, valve 200 seats on a shoulder 250 and seals off the tank vent line 20 to extinguish any flame or fire.

The opposing end 260 of the connecting rod 50 is connected to counterweight 60. Near the end 260 of the connecting rod 50 is connected one end 270 of the fusible link 70 by means of a cotter pin 272. The opposing end 280 of the fusible link 70 is connected by means of cotter pins 282 and 284 to one end 290 of the extension arm 80 which is rigidly affixed at its opposing end 300 to container 40 by means of a tap screw 310. In this fashion, the extension arm 80 is configured to rigidly hold the fusible link 70 and the connecting rod 50 in the outlet path 100 from the tank vent line 20. The legs of cotter pin 284 engages the eyelet of cotter pin 282 to provide a manual override feature. Hence, the fusible link 70, in the event of a fire, is directly held in the path 100 of the flame and rapidly melts to release the connecting rod 50 from the extension arm 80.

As shown in FIG. 3, when the flammable vapors from the tank vent line 20 ignite the fusible link 70 melts and the connecting rod 50 separates from the rigid extension arm 80 to close the valve 200 against shoulder 250. In the preferred embodiment, the fusible link is made from material which melts at 165° F. such as solder. In the closed position, the valve 200 shuts off the flow of the flammable vapors and the fire is extinguished or as conventionally known is "snuffed out". The counterweight 60 shown in FIG. 3 is different from that in FIG. 2 and comprises a second embodiment.

A manual override is provided to the flame snuffer of the present invention by means of connecting a cable 110 to a tiedown 320 on the end of rod 50. The cable 110 is connected to a lanyard 120, as shown in FIG. 1, remotely located from the output 22 of the tank vent line 20. Hence, the valve 200 of the present invention can be closed by applying a manual force in excess of a predetermined amount of force on lanyard 120 which is transmitted through cable 110 to the tiedown 320 at the counterweight 60. The applied manual force causes the connecting rod 50 to release from the extension arm 80 by physically breaking the fusible link 70 or by releasing the legs of cotter pin 284 from the eyelet of cotter pin 282. In the preferred embodiment, the release occurs when the predetermined force exceeds eight pounds of force. The counterweight 60, in the preferred embodiment provides a two pound force and a one-eighth inch steel cable is utilized for cable 110.

Figure 4:
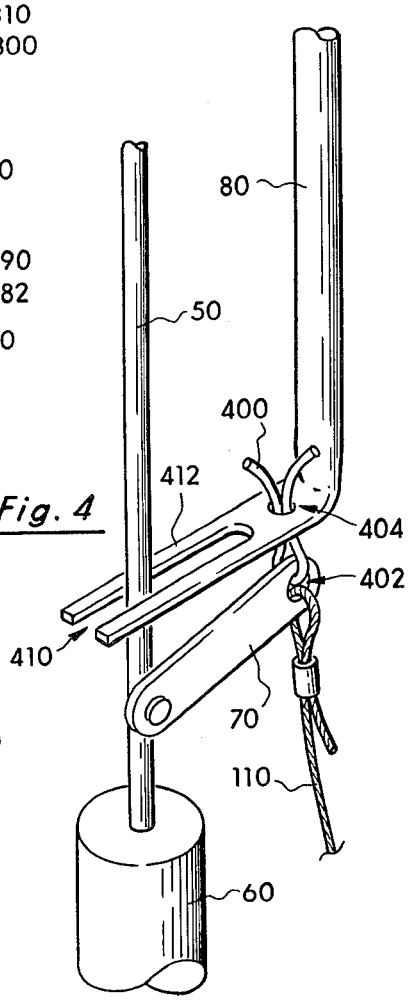
FIG. 4 illustrates an alternative embodiment, in partial perspective, for releasing the fusible link from the rigid supporting arm.

In an alternate embodiment for the manual override and as shown in FIG. 4, a cotter pin 400 interconnects a hole 402 in the fusible link 70 with a hole 404 in the rigid arm 80 to provide a release of the fusible link 70 itself from the arm 80 when a manual force in excess of a predetermined amount of force is applied to cable 110 which is directly connected to hole 402 of the fusible link 70. In this embodiment, the arm 80 terminates in a slot 410 formed on a flat bent portion 412 to prevent the counterweight 60 from swaying in the wind. The manual force releases the link 70 from the arm 80 and acts to directly close the valve 200.

While the fire snuffer of the present invention has been specifically set forth in the above disclosure for use on atmosphere condensate hydrocarbon storage tanks, it is to be understood that modifications and variations to the apparatus can be made which would still fall within the scope and coverage of the appended claims herewith for use on any atmospheric tank venting flammable gas or fumes.

I claim:

1. An improved automatic flame snuffer with manual override for the vent line (20) of a tank (10), said flame snuffer having a valve (200), a fusible link (70), and a counterweight (60) connected to said valve (200) and operatively connected to said fusible link (70) so that said fusible link (70), in the presence of flame, melts thereby allowing said counterweight (60) to close said valve (200) over said vent (20), said improved flame snuffer comprising:

means (40, 24) containing said valve (200) for engaging the end of said vent line (20), said engaging means (40, 24) directing the outlet of said vent line (20) in a downward path (100), a rod (50) coupled at one end (210) to said valve (200) with the opposing end (260) being attached to said counterweight (60), a first end (270) of said fusible link (70) being attached near the aforesaid opposing end (260) of said rod (50), a rigid arm (80) attached at one end (300) to said engaging means (40) and attached on its opposing end (290) to the second end (280) of said fusible link (70), said arm (80) supporting said fusible link (70) and said rod (50) in said downward path (100) of said vent outlet (22) so that said fusible link (70) is positioned directly in the path (100) of the flame when fire emanates from said vent (20) in order to melt said fusible link (70) thereby releasing said rod (50) from said arm to close said valve, means (110) coupled to said rod (50) for selectively applying a force to said fusible link (70) to release said rod (50) from said arm (80) in order to manually close said valve (200) over said outlet (22) when said applied force is greater than a predetermined amount of force, and means (120) remote from said vent (20) interconnected with said applying means (110) for receiving said applied force, said valve (200) closing over said outlet (22) when either said fusible link (70) melts or when said fusible link (70) releases from said rod (80) when said applied force exceeds said predetermined force.

2. An improved automatic flame snuffer with manual override for the vent line (20) of a tank (10), said flame snuffer having a valve (200), a fusible link (70), and a counterweight (60) connected to said valve (200) and operatively connected to said fusible link (70) so that said fusible link (70), in the presence of flame, melts thereby allowing said counterweight (60) to close said valve (200) over said vent (20), said improved flame snuffer comprising:

means (40, 24) containing said valve (200) for engaging the end of said vent line (20), said engaging means (40, 24) directing the outlet (22) of said vent line (20) into a predetermined path (100), a rod (50) coupled at one end (210) to said valve (200) with the opposing end (260) being attached to said counterweight (60), a first end (270) of said fusible link (70) being attached near the aforesaid opposing end (260) of said rod (50), means (80) attached at one end to said engaging means (40) and attached on its opposing end (290) to the second end (280) of said fusible link (70) for supporting said fusible link (70) and said rod (50) in said downward path (100) of said vent outlet (22) so that said fusible link (70) is positioned directly in the path (100) of flame when fire emanates from said vent (20) in order to melt said fusible link (70) thereby releasing said rod (50) from said supporting means (80) to close said valve, means (110) coupled to said rod (50) for selectively applying a force to said fusible link (70) to release from said arm (80) in order to manually close said valve (200) over said outlet (22) when said applied force is greater than a predetermined amount of force, and means (120) remote from said vent (20) interconnected with said applying means (110) for receiving said applied force, said valve (200) closing over said outlet (22) when either said fusible link (70) melts or when said fusible link (70) releases from said rod when said applied force exceeds said predetermined force.

3. An improved flame snuffer for the vent line (20) of a tank (10), said flame snuffer having a valve (200), a fusible link (70), and a counterweight (60) connected to said valve (200) and operatively connected to said fusible link (70) so that said fusible link (70), in the presence of flame, melts thereby allowing said counterweight (60) to close said valve (200) over said vent (20), said improved flame snuffer comprising:

means (40, 24) containing said valve (200) for engaging the end of said vent line (20), said engaging means (40, 24) directing the output (22) of said vent line (20) into a predetermined path (100), a rod (50) coupled at one end (210) to said valve (200) with the opposing end (260) being attached to said counterweight (60), a first end (270) of said fusible link (30) being attached near the aforesaid opposing end (260) of said rod (50), and means (80) attached at one end (300) to said engaging means (40) and attached on its opposing end (290) to the second end (280) of said fusible link (70) for supporting said fusible link (70) in said downward path (100) of said vent outlet (22) so that said fusible link (70) is positioned directly in the path (100) of flame when fire emanates from said vent (20) in order to melt said fusible link (70) thereby releasing said rod (50) from said supporting means (80) to close said valve (200).

4. An improved automatic flame snuffer with manual override for the vent line (20) of a tank (10), said flame snuffer having a valve (200), a fusible link (70), and a counterweight (60) connected to said valve (200) and operatively connected to said fusible link (70) so that said fusible link (70), in the presence of flame, melts thereby allowing said counterweight (60) to close said valve (200) over said vent (20), said improved flame snuffer comprising:

said valve (40, 200) being capable of engaging the end of said vent line (20) for directing the outlet (22) of said vent line (20) into a predetermined path (100), a rod (50) coupled at one end (210) to said valve (200) with the opposing end (260) being attached to said counterweight (60), a first end (270) of said fusible link (70) being attached near the aforesaid opposing end (260) of said rod (50), a rigid arm (80) attached at one end (300) to said valve (200, 40) and attached on its opposing end (290) to the second end (280) of said fusible link (70) for supporting said fusible link (70) in said predetermined path (100) of said vent outlet (22) so that said fusible link (70) is positioned directly in the path of flame when fire emanates from said vent (20) in order to melt said fusible link (70) thereby releasing said rod (50) from said arm (80) to close said valve (20), means (110, 120) coupled to said rod (50) and counterweight (60) for selectively applying a manual force to said fusible link (70) to release said rod (50) from said arm (80) in order to manually close said valve (200) over said outlet (22) when said applied force is greater than a predetermined amount of force.

5. An improved automatic flame snuffer for the vent line (20) of a tank (10), said flame snuffer having a valve (200), a fusible link (70), and a counterweight (80) connected to said valve (200) and operatively connected to said fusible link (70) so that said fusible link (70), in the presence of flame, melts thereby allowing said counterweight (60) to close said valve (200) over said vent (20), said improved flame snuffer comprising:

means (40, 24) containing said valve (200) for engaging the end of said vent line (20), said engaging means (40, 24) directing the outlet (22) of said vent line (20) in a downward path (100), a rod (50) coupled at one end (210) to said valve (200) with the opposing end (260) being attached to said counterweight (60), a first end (270) of said fusible link (70) being attached near the aforesaid opposing end (260) of said rod (50), and a rigid arm (80) attached at one end (300) to said engaging means (40) and attached on its opposing end (290) to the second end (280) of said fusible link (70), said arm (80) supporting said fusible link (70) and said rod (50) in said downward path (100) of said vent outlet (22) so that said fusible link (70) is positioned directly in the path of flame when fire emanates from said vent (20) in order to melt said fusible link (70) thereby releasing said rod (50) from said arm (80) to close said valve (200).

* * * * *